US007491065B2

(12) United States Patent
Wagner

(10) Patent No.: US 7,491,065 B2
(45) Date of Patent: Feb. 17, 2009

(54) SURFACE MOUNT TRAILER ELECTRICAL CONNECTOR

(76) Inventor: Karl Wagner, 19682 Alexandrite Dr., Bend, OR (US) 97702

( * ) Notice: Subject to any disclaimer, the term of this patent is extended or adjusted under 35 U.S.C. 154(b) by 0 days.

(21) Appl. No.: 11/983,121

(22) Filed: Nov. 6, 2007

(65) Prior Publication Data

US 2008/0113522 A1 May 15, 2008

Related U.S. Application Data

(60) Provisional application No. 60/858,991, filed on Nov. 14, 2006.

(51) Int. Cl.
*H01R 33/00* (2006.01)

(52) U.S. Cl. ..... 439/35; 439/490

(58) Field of Classification Search ..... 439/34–36, 439/490

See application file for complete search history.

(56) References Cited

U.S. PATENT DOCUMENTS 4,781,393 A 11/1988 Jeter
5,380,209 A 1/1995 Converse, Jr. et al.
5,443,389 A 8/1995 Hughes
5,549,478 A 8/1996 McGuire
5,732,966 A 3/1998 Menard et al.
5,876,240 A 3/1999 Derstine et al.
6,259,170 B1 7/2001 Limoge et al.
6,663,417 B1 12/2003 Hung
6,685,502 B2 2/2004 Wheeler
7,118,379 B1 * 10/2006 Wang ..... 439/35

* cited by examiner

*Primary Examiner*—Javaid Nasri
(74) *Attorney, Agent, or Firm*—Hancock Hughey LLP

(57) ABSTRACT

An improved, low profile, surface mounted female electrical connector for mounting to a vehicle. The connector has a flat rear surface that facilitates mounting on many different vehicles in many different locations. The connector may be mounted with or without drilling holes in the tow vehicle. The connector includes easy-to-use wire connectors with LED indicator lights to verify correct electrical connections between the tow vehicle and the electrical connector.

8 Claims, 4 Drawing Sheets

SURFACE MOUNT TRAILER ELECTRICAL CONNECTOR

This application claims the benefit of U.S. Provisional Patent Application No.: 60/858,991, filed Nov. 14, 2006.

FIELD OF THE INVENTION

This invention relates to electrical wiring interfaces for connecting the electrical system of a vehicle to a trailer or other device being towed by the vehicle, and more particularly to an electrical connector system for mounting on the towing vehicle that mounts on a cooperative surface and provides an improved electrical wiring connection to the trailer.

BACKGROUND OF THE INVENTION

Most trailers that are towed by vehicles are connected to the vehicle's electrical system. The vehicle's electrical system powers and operates the trailer lights (e.g., running lights, turn signals, brake lights, etc.) and often the trailer brakes. Usually the trailer has a standard "pigtail" electrical connector—typically a male plug—that inserts into a female receptacle on the vehicle. The receptacle on the vehicle may be either original equipment installed by the manufacturer, or an after-market device installed by the consumer. After the trailer has been mechanically attached to the towing vehicle, the electrical system is connected and it is checked to verify proper operation and electrical connections.

There are many standard electrical interface connections between the vehicle and the trailer, including 7 terminal sockets, 6 terminal sockets, and 4 terminal flat sockets to name a few examples. The specific type of electrical interface connector used on any give vehicle and trailer combination depends upon several factors, including the age of the towing vehicle, the age of the trailer, the electrical demands of the trailer, etc. For connectors of the receptacle type, the towing vehicle's receptacle is typically mounted by installing an additional mounting bracket, or drilling a relatively large hole into a sturdy structure such as a frame part or a bumper in a location near the hitch area that has adequate clearance behind the surface for the rearward protruding part of the receptacle and the wiring connected to it, the hole being sufficiently large to receive the female socket device, then attaching the electrical wiring to the receptacle and attaching the receptacle to the vehicle. Attaching the receptacle to the vehicle typically requires between two and four additional holes for the mounting screws.

The present invention relates to an improved female electrical receptacle system for mounting to a towing vehicle and which defines a system for electrically connecting the trailer's wiring system to that of the towing vehicle. The receptacle has a rear surface that facilitates mounting the receptacle on many different vehicles in many different possible locations. The receptacle is a surface-mount system that does not require drilling a large hole to accommodate the female socket portion of the connector. Moreover, in many cases it is not necessary to drill even a smaller hole to route wiring from the vehicle to the receptacle. The receptacle includes easy-to-use wire terminals with corresponding light emitting diode (LED) indicator lights to provide visual indication of the electrical signals from the towing vehicle and to verify correct electrical signals from the tow vehicle.

BRIEF DESCRIPTION OF THE DRAWINGS

The invention will be better understood and its numerous objects and advantages will be apparent by reference to the following detailed description of the invention when taken in conjunction with the following drawings.

DETAILED DESCRIPTION OF THE PREFERRED EMBODIMENTS

As noted above, the present invention defines an improved electrical interface for connecting a towing vehicle's 12 volt electrical system to the electrical system of a towed trailer. While the receptacle shown and described herein is of the 7 terminal round type, it will be appreciated that the principles of the invention apply equally to other conventional pigtail types and connectors. The specific type of towing vehicle and towed trailer are unimportant and may vary widely. Nonetheless, as used herein the towing vehicle is referred to with reference number 3 and the towed vehicle or trailer with reference number 5.

Figure 1:
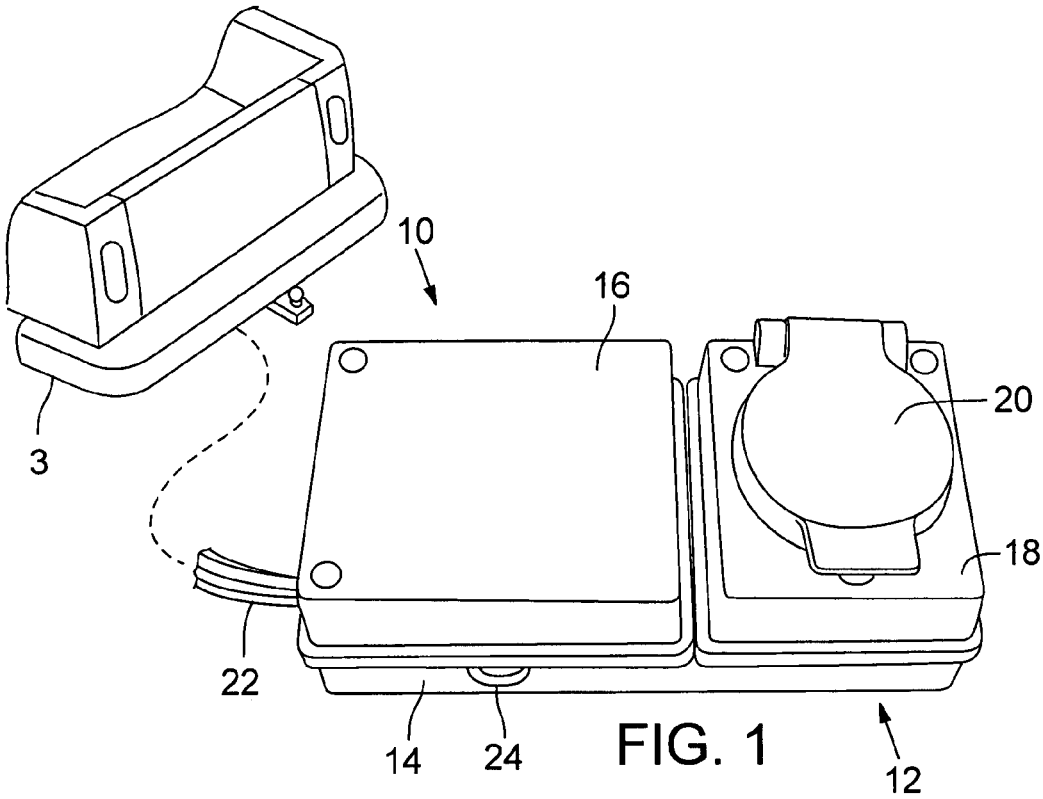
FIG. 1 is a front perspective view of a first illustrated embodiment of an electrical connector according to the present invention.

With reference to FIG. 1, a first illustrated connector 10 comprises a three-piece housing 12 including a generally rectangular base 14 and two removable access panels, namely, wiring access panel 16 and receptacle access panel 18. The receptacle access panel 18 includes a spring-loaded hatch 20, which when opened (see, e.g., FIG. 3), provides access to the receptacle terminals so that a trailer's male pigtail connector (see, e.g, FIG. 4) may be plugged into the receptacle and thereby make an electrical connection between the towing vehicle and the towed trailer. As best viewed in FIG. 3, the interior surface of hatch 20 includes a protruding latch 21 that interfaces with a cooperative lip on the male plug to retain the male plug seated in the receptacle when the plug is inserted into the receptacle. Base 14 includes a planar back panel 15.

Wiring access panel 16 and receptacle access panel 18 are attached to base 14 with suitable fasteners, such as screws. The panels may similarly be attached to the base with snap-fit attachments. Preferably, the panels attach snugly to the base to make a tight seal therebetween. An optional gasket may be installed between the base and the panels to enhance the seal between the panels and the base. Nonetheless, the seal between the base and the panels is not watertight, and a drain hole such as an access port provides a route for water to drain from the connector after, for example, immersion of the connector in water while launching a boat.

Base 14 includes one or more wire access ports that allow the wiring from the vehicle to be attached to the connector. In FIG. 1 wires 22 are seen leading into the base 14 through a wire access port, one of which is visible in FIG. 1 and is labeled with reference number 24. Preferably, base 14 includes plural wire access ports such as port 24 that define a variety of wire entry locations into the base so that there are many options for routing wire into the base depending upon the location that the base is mounted on the vehicle, and the position of the vehicle's wiring relative to the mounting location. Typically, base 14 includes at least 3 ports 24—one positioned along each of the three outer exposed walls of the base, and, as detailed below, several knockout plugs in the planar rear back surface 30 of base 14.

Figure 2:
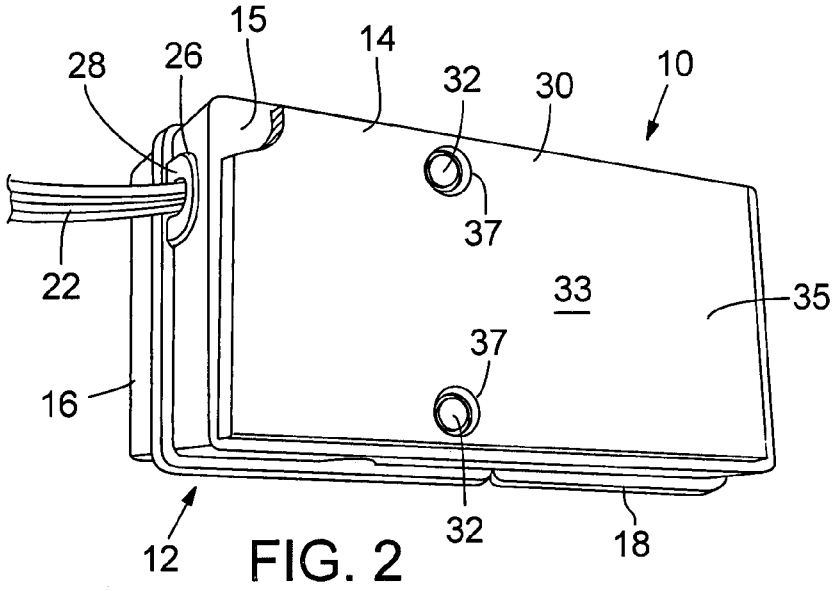
FIG. 2 is a rear perspective and partially cut away view of the electrical connector shown in FIG. 1.

Turning to FIG. 2, the rear of the connector 10 is shown to be generally flat. Wire access port 26, through which wires 22 lead, includes a rubber grommet 28 that helps prevent moisture from entering the interior of housing 12 Each of the access ports is provided with a rubber grommet 28. When the connector 10 is shipped to a consumer, the rubber grommets do not have openings through which the wires 22 are inserted, but instead are solid. The consumer cuts the center portion of the solid grommet after the consumer decides which access port the wiring will lead through. Because the back surface 30 of base 14 is flat, the connector 10 may be mounted to any flat surface on the towing vehicle 3. The connector may be mounted to an appropriate surface on a vehicle in many different and equivalent ways, including with double-sided adhesive-coated foam, or with screws.

In a first preferred embodiment, connector 10 is provided with an adhesive pad 33 that includes a protective backing sheet 35 that shields the underlying adhesive material prior to use. The adhesive pad 33 is fixed to the planar rear panel 15 of the base 14 of housing 12, typically with adhesive provided with the pad. The protective backing sheet remains on the outer, exposed surface of the pad until the housing is ready to be installed by the user. At that time, the protective backing sheet 35 is removed to expose the underlying adhesive and the housing is mounted to a desired surface on the towing vehicle. There are numerous very high strength adhesive pads commercially available on the market that suffice for use with the present invention. One exemplary product is available from 3M and is sold under the trademark VHB. The adhesive in these products provides an highly secure bond between the housing and the vehicle.

Figure 5:
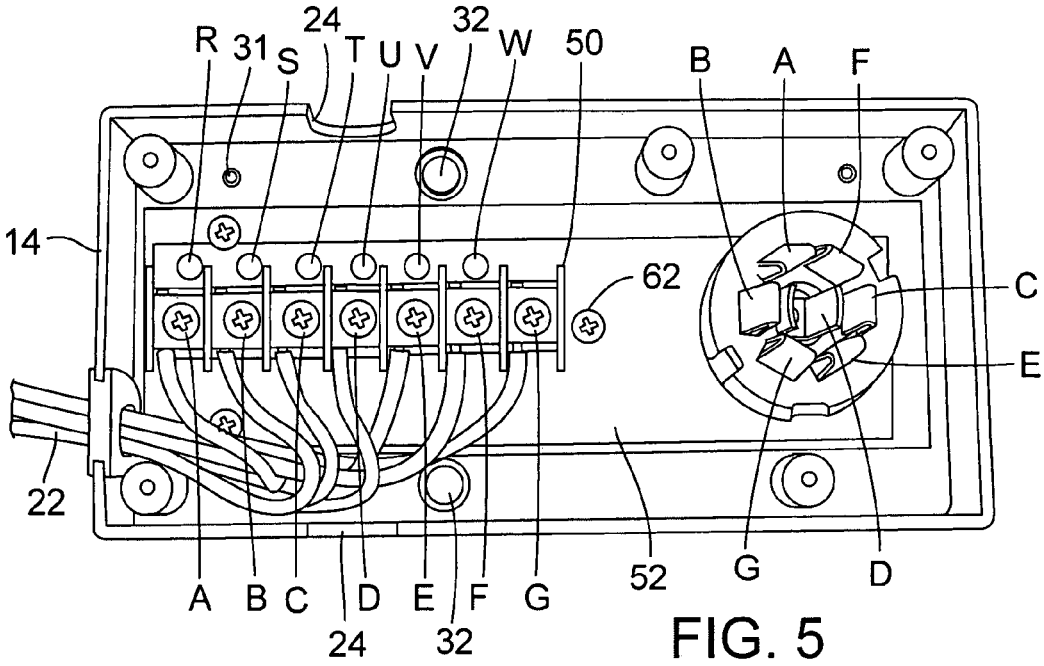
FIG. 5 is a front view of the connector shown in FIG. 4 with the access panel covering the receptacle connectors removed.

If the connector 10 is mounted to a vehicle with screws, the screws are threaded through screw indents such as indents 31 inside of the housing as shown in FIG. 5. The indents 31 are provided only to give a recommended location for the mounting screws. It will be understood that screws may be combined with an adhesive pad 35 to supplement the holding strength of the adhesive bond between the connector and the vehicle. For example, if the preferred mounting location on the vehicle is not entirely flat, or if the surface is flat but has too much texture or contamination, a combination of the adhesive pad and screws may be utilized.

In the event that the vehicle's wiring needs to enter housing 12 from the rear of the housing 12, knockout plugs 32 are provided for threading the wiring into the housing. The knockout plugs 32 are easily removed so the wiring may be threaded through the resulting openings.

Figure 3:
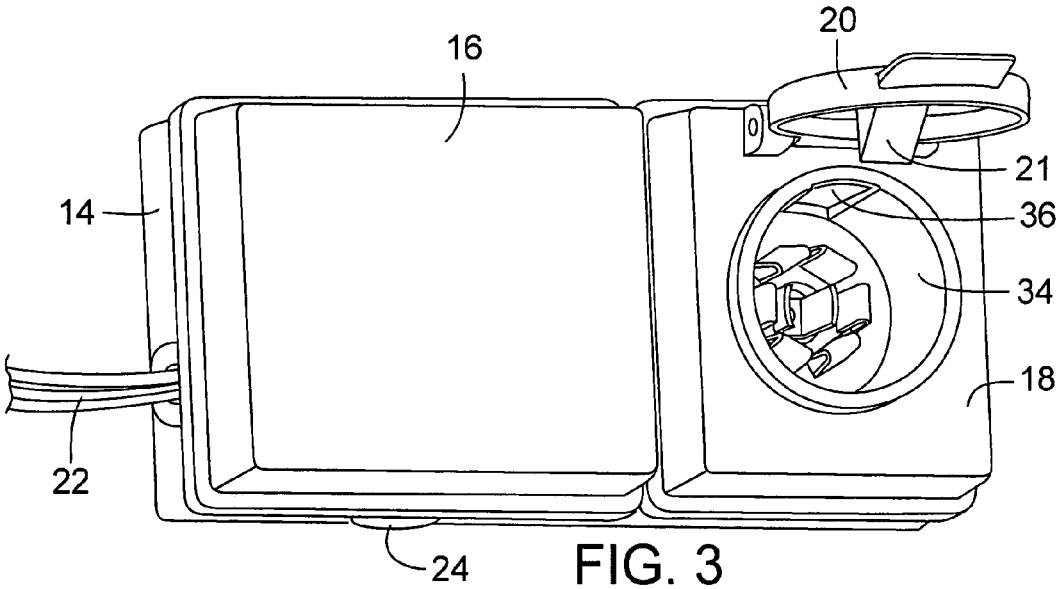
FIG. 3 is a front perspective view of an electrical connector similar to the one shown in FIG. 1, with the hinged and sprung plate that covers the female receptacle in the open position. In the case of the connector shown in FIG. 3, the receptacle is of the type used for a conventional 7 terminal round pigtail that runs from the trailer.

When hatch 20 is in the open position as illustrated in FIG. 3, a round socket 34 is exposed. Socket 34 is a conventional receptacle for a 7 terminal round pigtail, and thus includes a keyway 36 that mates to a cooperative structure on the pigtail so that the pigtail is always oriented relative to the socket in the proper orientation. At the base of socket 34 there are 6 electrical terminals arranged in a circular pattern and one central electrical connector in the center of the circular pattern. These 7 terminals serve as the electrical connections between the pigtail and the vehicle's electrical system.

Figure 4:
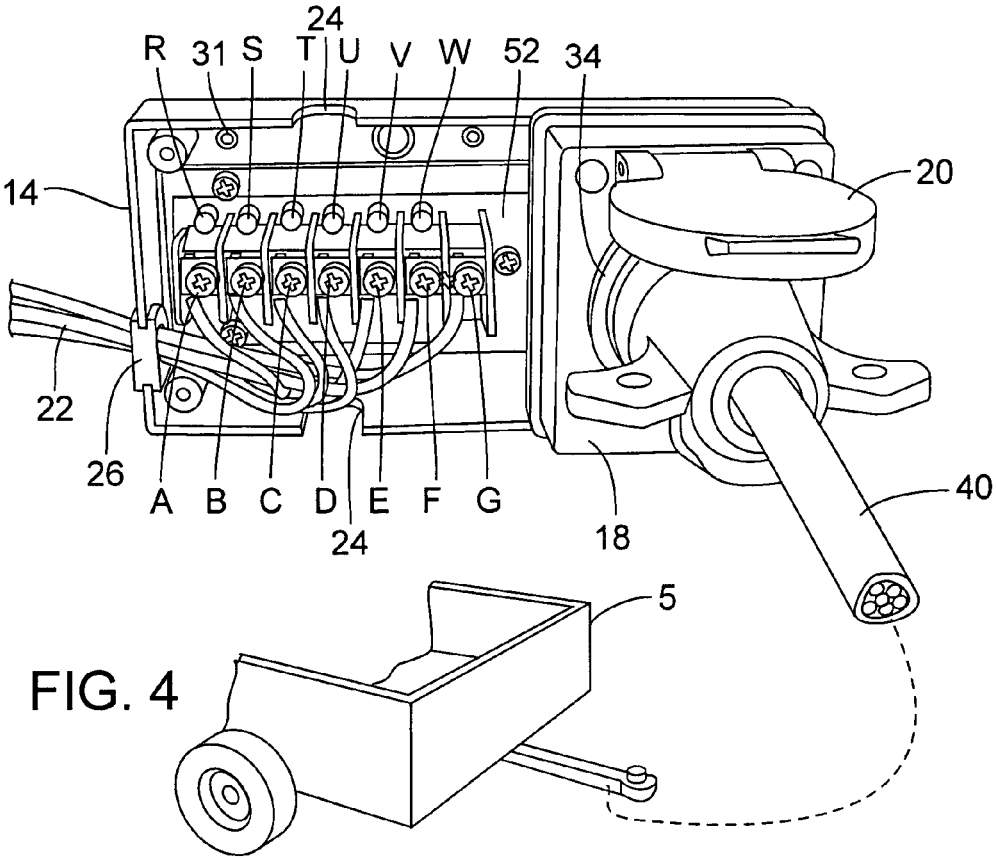
FIG. 4 is a front view of the electrical connector shown in FIG. 1 with an access panel removed to expose the electrical connections in the housing, the primary circuit board, and a conventional 7 terminal round pigtail plugged into the receptacle.

In FIG. 4 the trailer's pigtail connector 40 is shown plugged into socket 34 of connector 10. Wiring access panel 16 is removed in FIG. 4 to illustrate the wiring terminal connector strip 50, also called a barrier strip, which comprises a series of electrical interconnect terminals that allow wiring 22 from the vehicle to be electrically connected to the connector 10. In FIG. 4 there are seven wiring terminals, and seven wires from the vehicle's electrical system. The seven wiring terminals, labeled with letters A through G, are electrical terminals that are mounted to a circuit board 52, which is secured in the interior of base 14. A separate electrical trace is formed on circuit board 52 and runs to the appropriate electrical terminal in receptacle 34 for each of the seven wiring terminals (see FIG. 6 and explanation below). The traces complete the electrical connections from the vehicle's system to connector 10.

Figure 6:
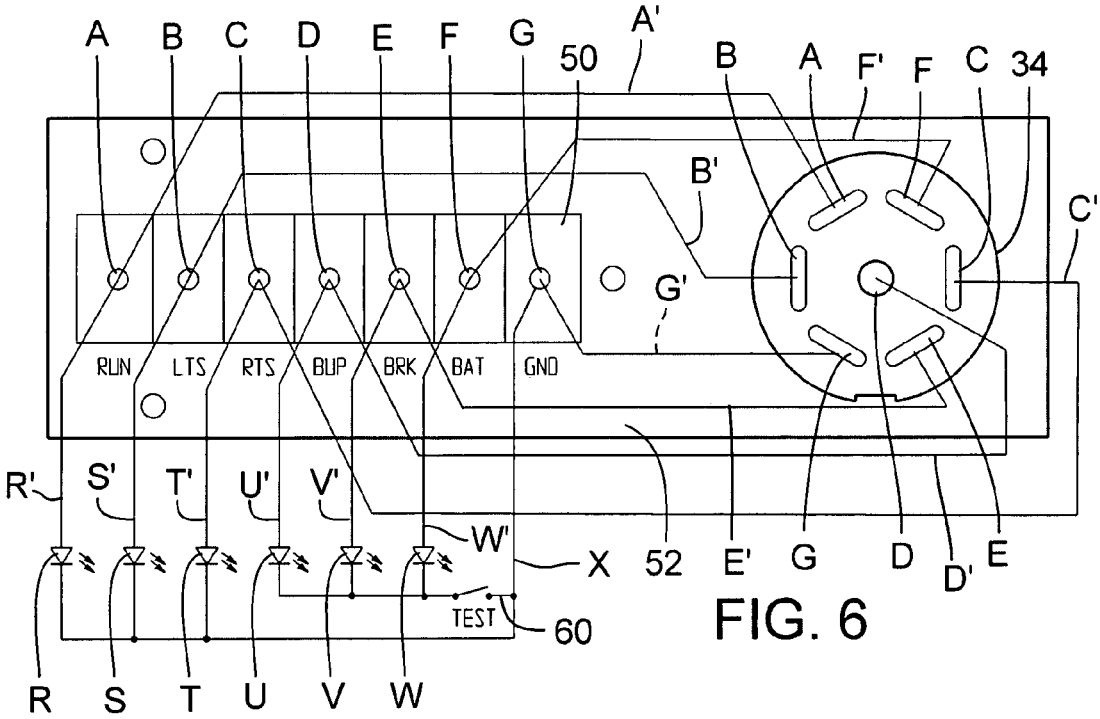
FIG. 6 is an exemplary electric circuit diagram according to the present invention.

LED indicator lamps, labeled in FIG. 4 with letters R through W, are also electrically connected to each of the seven wiring terminals A through G. The LEDs illuminate when the corresponding circuit is energized with electricity from the vehicle's 12 volt electrical system. The LEDs allow quick visual verification of correct electrical connection between the towing vehicle and the wiring terminals without the need for external test lights, etc. Each of the wiring terminals A through G are also labeled with a convenient marking to indicate which wire from the towing vehicle that has a specified function should be connected to a specific terminal. As illustrated in FIG. 6, for instance, "RUN" for running lights such as marker lights, tail lights, etc., "LTS" for left turn signal, "RTS" for right turn signal, "BUP" for back-up lights, "BRK" for electric brake, "BAT" for battery charge, and "GND" for ground, return. With reference to FIG. 5, the seven terminal connections in socket 34 may be labeled with the identical marking so that a user knows immediately which of the 7 terminals in socket 34 electrically connect to which of the 7 wiring terminals.

Each of the terminals A through G thus has an electrical trace in circuit board 52 that directly connects the terminal in wiring terminal connector strip 50 to a corresponding socket terminal in socket 34. With reference to FIG. 5, the letters A through G have been assigned to specific socket terminals in socket 34. Thus, wiring terminal A corresponds to and is electrically connected to socket terminal A—there is an electrical trace in circuit board 52 running from wiring terminal A directly to socket terminal A. Similarly, wiring terminal B corresponds to and is electrically connected to a socket terminal B—there is an electrical trace running from wiring terminal B to socket terminal B, and so on. The electrical schematic for connector 10 is shown in FIG. 6 where it may be seen that the traces in circuit board 52 from the socket terminals in socket 34 to the corresponding wiring terminals in connector strip 50 are labeled with A', B', C', D', E', F' and G'. The traces that provide the electrical connections to the LEDs R, S, T, U, V and W are labeled with R', S', T', U', V' and W', each of which return to the ground terminal G through return trace X.

When the electrical connections from the vehicle's 12 volt system to connector 10 have been completed, the LED lights provide a quick visual indicator of the presence of an electrical signal at the terminals in the connector. It will be appreciated from the wiring diagram of FIG. 6 that the LEDs R, S and T (i.e., R associated with the tail, marker and running lights, S associated with the left turn signal, and T associated with the right turn signal) will be powered and therefore illuminated whenever those functions are used on the towing vehicle regardless of whether a trailer is connected. On the other hand, the LEDs associated with the backup lights (U), electric brakes (V) and Battery charge (W) have the potential to be illuminated continuously, depending upon the manner in which the towing vehicle is electrically wired, which could cause unwanted battery drain. Accordingly, a test switch 60 is provided that may be closed to verify that the electrical connections between the vehicle and the connector 10 are correct and otherwise opened to prevent unwanted drain on the vehicle's battery. Specifically, switch 60 is defined by a manually operable set screw 62 in circuit board 52. By screwing set screw 62 inwardly into circuit board 52—that is, clockwise—the switch is closed and the LEDs U, V and W, which may be continuously powered, are provided with a ground return, which results in the LEDs being illuminated so that the correct electrical connections may be verified. The switch is opened by screwing set screw 62 outwardly respective of circuit board 52—counterclockwise—to open the switch circuit and thereby prevent drain on the battery.

With returning reference to FIG. 1, the connector 10 according to the present invention has a very low profile, yet allows a trailer pigtail to be plugged directly into the unit. The connector may be mounted directly to any appropriate cooperative surface such as a bumper as described above, typically without the need for drilling holes in the bumper.

Figure 7:
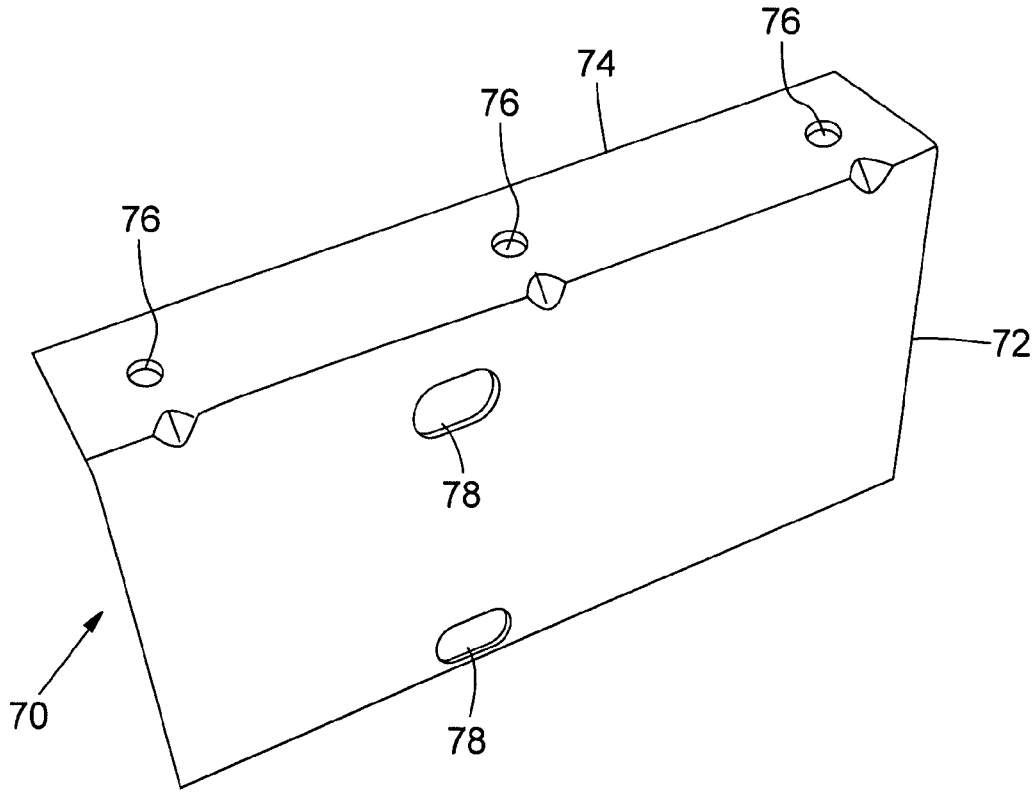
FIG. 7 is a perspective view of an optional mounting bracket for the electrical connector shown in FIG. 1.

In some situations it may be desirable to mount connector 10 to vehicle 3 on an optional bracket 70 shown in FIG. 7. Bracket 70 is a heavy duty L-shaped member having a first section 72 for receiving the connector 10, and a second section 74 for mounting to a surface on vehicle 3. Typically, the bracket 70 is mounted to a lower surface of vehicle 3 with screws inserted through openings 76 in section 74. The connector 10 is then mounted to first section 72, for example, with the adhesive pad described above. Section 72 includes openings 78 that correspond to the positions of knock out plugs 32 of base 14 if the user wants to route the wiring from vehicle 3 through these openings. Adhesive pad 33 includes pre-cut openings 37 that overlie the knockout plugs 32. If the wires from the tow vehicle are routed through the knock out plugs 32, the pre-cut openings, which are slightly smaller in diameter than the knockout plugs, function as grommets.

It will be appreciated that certain modifications may be made to the invention described herein without departing from the scope of the invention defined in the claims. For example, it is not necessary use a circuit board 52. Instead, the wiring terminals may be mounted on a mounting member with each of the terminals electrically connected directly to the corresponding socket connections. In addition, some states allow for towing multiple trailers. As such, it will be understood that the towing vehicle may be a first trailer and the towed vehicle a second trailer.

While the present invention has been described in terms of a preferred embodiment, it will be appreciated by one of ordinary skill that the spirit and scope of the invention is not limited to those embodiments, but extend to the various modifications and equivalents as defined in the appended claims.

I claim:

1. An apparatus for interconnecting the electrical system of a towing vehicle to the electrical system of a trailer, comprising:

a housing having a planar back surface configured for mounting the housing on the towing vehicle, wherein the planar back surface defines a plane and no portion of the housing extends beyond said plane;

a plurality of wire terminal connectors in the housing, each wire terminal connector corresponding to a specific electrical function for the towing vehicle;

a trailer electrical interface having a plurality of electrical terminals, each terminal corresponding to a specific electrical function for the trailer;

an electrical connection from each wire terminal connector to a corresponding electrical terminal in the trailer electrical interface;

wherein the housing may be mounted on a mounting surface of the towing vehicle that has no apertures in said mounting surface and such that the apparatus does not extend through the mounting surface.

2. The apparatus according to claim 1 wherein the plurality of wire terminal connectors are mounted on a circuit board and the electrical connections from the wire connectors to the trailer electrical interface are defined by electrical traces in the circuit board.

3. The apparatus according to claim 2 wherein the trailer electrical interface is mounted on the circuit board.

4. The apparatus according to claim 3 wherein the trailer electrical interface defines a female electrical socket configured for receiving a male pigtail electrical plug from the trailer.

5. The apparatus according to claim 1 including an indicator lamp corresponding to and associated with each of the plural wire terminal connectors to indicate a proper electrical connection between the electrical system of the towing vehicle and the wire terminal connectors.

6. The apparatus according to claim 5 including a test circuit for at least some of the indicator lamps, said test circuit manually openable and closable.

7. The apparatus according to claim 6 wherein the indicator lamps are defined by LEDs.

8. The apparatus according to claim 1 including an adhesive member affixed to the mounting surface and having exposable adhesive material for affixing the housing to the towing vehicle.

* * * * *